US010529474B2

(12) United States Patent
Kadota et al.

(10) Patent No.: US 10,529,474 B2
(45) Date of Patent: Jan. 7, 2020

(54) RARE-EARTH PERMANENT MAGNET

(71) Applicant: TDK CORPORATION, Tokyo (JP)

(72) Inventors: Shogo Kadota, Tokyo (JP); Kenichi Suzuki, Tokyo (JP); Yuji Umeda, Tokyo (JP); Ryuji Hashimoto, Tokyo (JP); Keiji Takeda, Tokyo (JP)

(73) Assignee: TDK CORPORATION, Tokyo (JP)

( * ) Notice: Subject to any disclaimer, the term of this patent is extended or adjusted under 35 U.S.C. 154(b) by 427 days.

(21) Appl. No.: 15/304,193

(22) PCT Filed: Mar. 10, 2015

(86) PCT No.: PCT/JP2015/056915

§ 371 (c)(1),
(2) Date: Oct. 14, 2016

(87) PCT Pub. No.: WO2015/159612

PCT Pub. Date: Oct. 22, 2015

(65) Prior Publication Data

US 2017/0047151 A1 Feb. 16, 2017

(30) Foreign Application Priority Data

| | | |
|---|---|---|
| Apr. 15, 2014 | (JP) | 2014-083745 |
| Sep. 12, 2014 | (JP) | 2014-186459 |
| Jan. 9, 2015 | (JP) | 2015-002993 |
| Jan. 9, 2015 | (JP) | 2015-002994 |

(51) Int. Cl.

| | |
|---|---|
| ***H01F 1/055*** | (2006.01) |
| ***B22F 3/16*** | (2006.01) |
| ***H01F 1/058*** | (2006.01) |
| ***H01F 1/059*** | (2006.01) |

(Continued)

(52) U.S. Cl.
CPC ..... *H01F 1/057* (2013.01); *B22F 3/16* (2013.01); *C22C 38/005* (2013.01); *H01F 1/058* (2013.01); *H01F 1/059* (2013.01); *H01F 1/0556* (2013.01); *H01F 1/0557* (2013.01)

(58) Field of Classification Search
None
See application file for complete search history.

(56) References Cited

U.S. PATENT DOCUMENTS

RE34,838 E * 1/1995 Mohri ..... H01F 1/0571 148/302
2014/0065004 A1* 3/2014 Li ..... H01F 1/086 419/29

FOREIGN PATENT DOCUMENTS

JP S59-46008 A 3/1984
JP H04-346202 A 12/1992
(Continued)

OTHER PUBLICATIONS

Li, Journal of Applied Physics, 1991, vol. 69, p. 5515-5517. (Year: 1991).*

*Primary Examiner* — Xiaowei Su
(74) *Attorney, Agent, or Firm* — Oliff PLC

(57) ABSTRACT

To provide a permanent magnet which uses Ce of an abundant resource and has a great magnetic anisotropy in rare earth permanent magnets. To obtain a permanent magnet having a high magnetic anisotropy due to the trivalent Ce state by setting the abundance ratio C3/(C3+C4) in the main phase grains to be $0.1 \leq C3/(C3+C4) \leq 0.5$ where C3 denotes the number of trivalent Ce atoms and C4 denotes the number of tetravalent Ce atoms.

12 Claims, 1 Drawing Sheet

(51) Int. Cl.
*H01F 1/057* (2006.01)
*C22C 38/00* (2006.01)

(56) References Cited

FOREIGN PATENT DOCUMENTS

| | | |
|---|---|---|
| JP | H06-172936 A | 6/1994 |
| JP | H10-183308 A | 7/1998 |

* cited by examiner

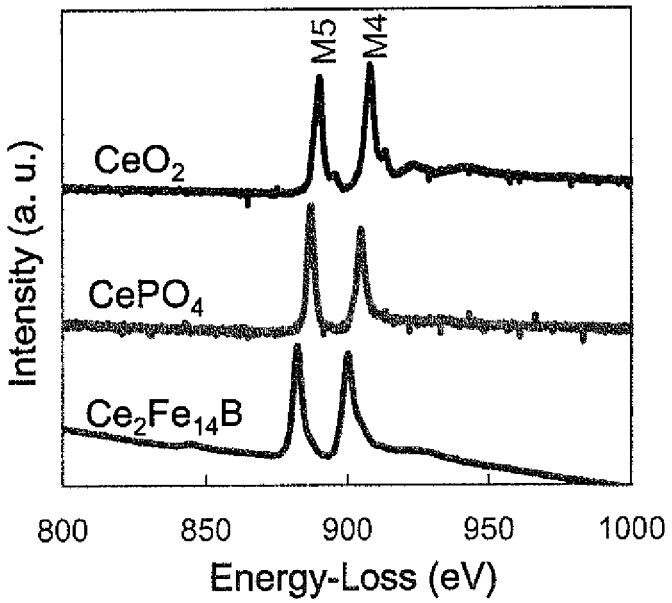
M5
M4
CeO2
CePO4
Ce2Fe14B
Intensity (a. u.)
800
850
900
950
1000
Energy-Loss (eV)

RARE-EARTH PERMANENT MAGNET

TECHNICAL FIELD

The present invention relates to a rare earth permanent magnet, and particularly relates to a permanent magnet that contains Ce as a part and the whole of the rare earth elements and utilizes a high magnetic anisotropy.

BACKGROUND ART

Rare earth magnets composed mainly of intermetallic compounds of rare earth elements with transition metal elements such as Fe and Co have a high magnetocrystalline anisotropy, and thus are widely used in consumer, industrial, and transport machinery and apparatuses and the like as a high-performance permanent magnet. In recent years, the demand for miniaturization of various kinds of electrical machinery and apparatuses has increased, and high-performance permanent magnets exhibiting higher magnetic properties have been desired in order to cope with this demand.

Rare earth permanent magnets containing a tetragonal $R_2T_{14}B$ compound ("R" represents a rare earth element, and "T" represents Fe or Fe that is partially substituted with Co) as the main phase are known to exhibit excellent magnetic properties, and have been a typical high-performance permanent magnet after being invented in 1982 (Patent Document 1).

R-T-B based permanent magnets in which the rare earth element "R" is Nd, Pr, Dy, Ho, or Tb have a great anisotropic magnetic field Ha, and thus they are preferred as a permanent magnet material. Among them, Nd—Fe—B based permanent magnets in which the rare earth element R is Nd have a saturation magnetization Is, the Curie temperature Tc, an anisotropic magnetic field Ha in good balance, and thus are widely used.

In addition, Patent Document 2 proposes a magnetic material having a high Fe concentration in the main phase and a high saturation magnetic flux density for a permanent magnet that contains an R-T compound having a $TbCu_7$ type crystal structure as the main phase.

Furthermore, Patent Document 3 proposes a magnetic material having the highest Fe concentration in the main phase among the permanent magnets whose main phase is an R-T compound having a $ThMn_{12}$ type crystal structure. Non-Patent Document 1 reports that the $Nd(Fe_{0.93}Co_{0.02}Mo_{0.05})_{12}N_y$ thin film in which the crystal structure of the main phase grains is a $ThMn_{12}$ type has a high saturation magnetic flux density of 1.62 T and a high coercivity of 693 kA/m.

Meanwhile, the consumption of rare earth elements that are a rarer element is increasing, and thus a magnet using an element abundant in resource among rare earth elements is desired in terms of price and stable supply.

CITATION LIST

Patent Document

Patent Document 1: JP 59-46008 A
Patent Document 2: JP 6-172936 A
Patent Document 3: JP 4-346202 A
Patent Document 4: JP 10-183308 A

Non-Patent Document

Non-Patent Document 1: Journal of Applied Physics, Vol. 75, pp. 6009, 1994

Among rare earth elements "R", Ce is known to exhibit a higher Clark number and to be more abundant than the other rare earth elements. Patent Document 4 discloses a Ce-T-B based permanent magnet of an R-T-B based permanent magnet whose rare earth element "R" is Ce, and discloses that a permanent magnet that has the $Ce_2Fe_{14}B$ phase as a base phase and occludes hydrogen so as to promote the volume expansion and to have a practical coercivity is obtained. However, the Ce-T-B—H based permanent magnet disclosed in Patent Document 4 does not have sufficient magnetic properties as compared to the Nd—Fe—B based permanent magnet. In addition, it is easily expected that the corrosion resistance decreases since hydrogen is contained in the main phase so that the reaction with oxygen is accelerated.

DISCLOSURE OF THE INVENTION

Problem to be Solved by the Invention

The present invention has been made in view of such circumstances, and an object thereof is to provide a rare earth permanent magnet using Ce abundant in resource, having a great magnetic anisotropy, and exhibiting a high corrosion resistance in rare earth permanent magnets.

Means for Solving Problem

In order to solve the above-mentioned problem and to achieve the object, the rare earth permanent magnet of the present invention is characterized by including main phase grains, wherein an abundance ratio C3/(C3+C4) in the main phase grains is $0.1 \leq C3/(C3+C4) \leq 0.5$, where C3 denotes the number of trivalent Ce atoms and C4 denotes the number of tetravalent Ce atoms in the main phase grains.

In the rare earth permanent magnet of the present invention, the main phase grains preferably include an R-T-X compound having a $Nd_2Fe_{14}B$ type crystal structure (space group $P4_2/mnm$), where "R" represents one or more kinds of rare earth elements including Ce or including Ce and Y, La, Pr, Nd, Sm, Eu, Gd, Tb, Dy, Ho, Er, Tm, Yb, and Lu, "T" represents one or more kinds of transition metal elements including Fe or Fe and Co, and "X" represents B or B and an element of Be, C, or Si that substitutes part of B.

In the rare earth permanent magnet of the present invention, the main phase grains preferably include an R-T compound having a $TbCu_7$ type crystal structure (space group P6/mmm), where "R" represents one or more kinds of rare earth elements including Ce or including Ce and Y, La, Pr, Nd, Sm, Eu, Gd, Tb, Dy, Ho, Er, Tm, Yb, and Lu, and "T" represents one or more kinds of transition metal elements including Fe or Fe and Co.

In the R-T compound having a $TbCu_7$ type crystal structure (space group P6/mmm), the main phase grains preferably further contain an interstitial element "X" ("X" represents one or more elements of N, H, Be, and C).

In the R-T compound having a $TbCu_7$ type crystal structure (space group P6/mmm), "R" is partially substituted with Zr in the main phase grains.

In the rare earth permanent magnet of the present invention, the main phase grains preferably include an R-T compound having a $ThMn_{12}$ type crystal structure (space group I4/mmm), where "R" represents one or more kinds of rare earth elements including Ce or including Ce and Y, La, Pr, Nd, Sm, Eu, Gd, Tb, Dy, Ho, Er, Tm, Yb, and Lu, and "T" represents one or more kinds of transition metal elements including Fe or Fe and Co or represents the transition metal elements partially substituted with "M" ("M" represents one or more kinds of Ti, V, Cr, Mo, W, Zr, Hf, Nb, Ta, Al, Si, Cu, Zn, Ga, and Ge).

In the R-T compound having a $ThMn_{12}$ type crystal structure (space group I4/mmm), the main phase grains preferably further contain an interstitial element "X" ("X" represents one or more kinds of elements of N, H, Be, and C).

In the rare earth permanent magnet of the present invention, the abundance ratio of the number of trivalent Ce atoms and the number of tetravalent Ce atoms in the main phase grains is preferably calculated from an electron energy loss spectrum.

Effect of the Invention

The present invention can achieve a permanent magnet obtaining a trivalent Ce state by adjusting the interatomic distance between the closest element and Ce through the combination of elements and utilizing a high magnetic anisotropy of trivalent Ce to have a high coercivity.

BRIEF DESCRIPTION OF DRAWINGS

The FIGURE is a spectrum of electron energy loss spectroscopy (EELS) of the main phase grains in Example 1 of the present invention and EELS spectra of the standard samples $CeO_2$ and $CePO_4$.

MODE(S) FOR CARRYING OUT THE INVENTION

Hereinafter, preferred embodiments of the present invention will be described in detail. Incidentally, the embodiments are illustrative rather than limit the invention, and all of the features and the combinations thereof described in the embodiments are not necessarily essential ones of the invention.

In the present embodiment, a state in which the 4f orbit of a Ce element is occupied by one electron is defined as a trivalent Ce state due to having an electronic structure similar to trivalent Ce in an ionic crystal, meanwhile, a state in which the 4f orbit of a Ce element is not occupied by any electron is defined as a tetravalent Ce state due to having an electronic structure similar to tetravalent Ce in an ionic crystal.

The present inventors have found out that an electron is stabilized in the 4f orbit of Ce by adjusting the interatomic distance between Ce and the neighboring element in the crystal in a rare earth permanent magnet, and a permanent magnet having a high magnetic anisotropy due to the trivalent Ce state is obtained.

The electron in the Ce element in a rare earth permanent magnet behaves as a conduction electron, but the present inventors believes that a state in which the electron in the flat-shaped 4f orbit of Ce is stabilized can be realized by adjusting the distance between Ce and the neighboring element.

In a rare earth permanent magnet, a high magnetic anisotropy can be expected by a state in which an electron is present in the Ce 4f orbit of the flat-shaped electron cloud, namely, by expression of the trivalent Ce state.

That is, it is possible to achieve a rare earth permanent magnet having a high magnetic anisotropy by adjusting the interatomic distance between Ce and the neighboring element to stabilize the electron in the Ce 4f orbit.

Furthermore, the present inventors have found out that a permanent magnet having a high coercivity is obtained without significantly impairing the corrosion resistance by realizing Ce in a trivalent state in a range of $0.1 \leq C3/(C3+C4) \leq 0.5$. The improvement in coercivity was not acknowledged even at room temperature when C3/(C3+C4) is smaller than 0.1. The present inventors believe that this is because the abundance of Ce in a trivalent state is not sufficient and the effect of a high uniaxial magnetic anisotropy of Ce in a trivalent state is not sufficiently obtained. The corrosion resistance significantly decreased when C3/(C3+C4) is greater than 0.5. The present inventors believe that this is because Ce in a trivalent state is unstable as compared to Ce in a tetravalent state and thus is likely to be oxidized.

Examples of the main phase of the rare earth permanent magnet in the present embodiment may include those including a Ce—Fe based one, a Ce—Fe—N based one, a Ce—Fe—B based one, a Ce—Co based one, a Ce—Co—N based one, and a Ce—Co—B based one, but the main phase is not limited to these in any way, and a part of Ce may be substituted with another rare earth element and/or the rare earth permanent magnet may be formed by concurrently using two or more kinds. In addition, examples of the crystal structure of the main phase of the rare earth permanent magnet in the present embodiment may include a $Nd_2Fe_{14}B$ type crystal structure (space group $P4_2/mnm$), a $TbCu_7$ type crystal structure (space group P6/mmm), a $ThMn_{12}$ type crystal structure (space group I4/mmm), a $CaCu_5$ type crystal structure (space group P6/mmm), a $Zn_{17}Th_2$ type crystal structure (space group R-3m), and a $Nd_5Fe_{17}$ type crystal structure (space group $P6_3/mcm$), but the crystal structure is not limited to these in any way, and the rare earth permanent magnet may be formed by concurrently using two or more kinds.

An R-T-X compound of which the main phase grains have a $Nd_2Fe_{14}B$ type crystal structure (space group $P4_2/mnm$), which is one of the present embodiment, will be specifically described. In the present embodiment, the R-T-X compound having a $Nd_2Fe_{14}B$ type crystal structure (space group $P4_2/mnm$) will be described as a $Nd_2Fe_{14}B$ type R-T-X compound hereinafter.

"R" in the $Nd_2Fe_{14}B$ type R-T-X compound represents one or more kinds of rare earth elements including Ce or including Ce and Y, La, Pr, Nd, Sm, Eu, Gd, Tb, Dy, Ho, Er, Tm, Yb, and Lu. A high magnetic anisotropy can be expected by a state in which an electron is present in the 4f orbit of Ce, namely, by the expression of a trivalent state. That is, by increasing the Ce amount, it is possible to expect a high magnetic anisotropy and to increase the coercivity of the permanent magnet. Incidentally, the proportion of Ce occupied in the entire rare earth elements is desired to be greater, and that the proportion of Ce is desired to be at least half or more with respect to the entire rare earth element amount.

"T" in the $Nd_2Fe_{14}B$ type R-T-X compound represents one or more kinds of transition metal elements including Fe or Fe and Co. By increasing the Co amount, it is possible to improve the Curie temperature and to reduce decrease in coercivity with respect to the temperature rise. In addition, it is possible to improve the corrosion resistance of the rare earth permanent magnet by increasing the Co amount. However, the magnetic anisotropy of the main phase grains changes from the perpendicular magnetic anisotropy to the in-plane magnetic anisotropy when the Co amount is excessive, and thus the Co amount is desirably set so as not to exceed the Fe amount.

"X" in the $Nd_2Fe_{14}B$ type R-T-X compound represents B or B and an element of Be, C, and Si that substitutes part of B. When "X" is B, the interatomic distance between Ce and the closest element takes an optimum value and the expression of a trivalent Ce state can be expected, and thus the proportion of B in "X" is desirably greater.

In addition, an R-T compound of which the main phase grains have a $TbCu_7$ type crystal structure (space group P6/mmm), which is one of the present embodiment, will be specifically described. In the present embodiment, the R-T compound having a $TbCu_7$ type crystal structure (space group P6/mmm) will be described as a $TbCu_7$ type R-T compound hereinafter.

"R" in the $TbCu_7$ type R-T compound represents one or more kinds of rare earth elements including Ce or including Ce and Y, La, Pr, Nd, Sm, Eu, Gd, Tb, Dy, Ho, Er, Tm, Yb, and Lu. A high magnetic anisotropy can be expected by a state in which an electron is present in the 4f orbit of Ce, namely, by the expression of a trivalent state. That is, by increasing Ce amount, it is possible to expect a high magnetic anisotropy and to increase the coercivity of the permanent magnet. Incidentally, the proportion of Ce in the entire rare earth elements is desirably greater, and the proportion of Ce is desirably at least half or more with respect to the entire rare earth element amount.

The amount of "R" in the $TbCu_7$ type R-T compound is preferably 6.3 at % or more and 37.5 at % or less. When the amount of "R" is less than 6.3 at %, the generation of the main phase is not sufficient, α-Fe exhibiting soft magnetism is deposited, and the coercivity significantly decreases. On the other hand, when "R" exceeds 37.5 at %, the volume ratio of the main phase decreases, and the saturation magnetic flux density decreases.

"T" in the $TbCu_7$ type R-T compound represents one or more kinds of transition metal elements including Fe or Fe and Co. The Co amount is desirably greater than 0 at % and 50 at % or less with respect to the total amount of "T". It is possible to improve the saturation magnetic flux density by adding Co at an appropriate amount. In addition, it is possible to improve the corrosion resistance of the rare earth permanent magnet by increasing the Co amount.

The $TbCu_7$ type R-T compound may contain an interstitial element "X", where "X" represents elements consisting of one or more of N, H, Be, and C. The amount of "X" is desirably 0 at % or more and 10 at % or less. It is possible to improve the coercivity as "X" intrudes into the crystal lattice. It is believed that this is because the magnetocrystalline anisotropy is improved by the interstitial element.

Part of "R" in the $TbCu_7$ type R-T compound may be substituted with Zr. The substitution with Zr is desirably greater than 0 at % and 50 at % or less with respect to the total amount of "R". It is possible to improve the saturation magnetic flux density as the substitution is conducted in such a range. It is believed that this is because the localization of the 3d electrons in Fe is promoted by the substitution with Zr.

In addition, an R-T compound of which the main phase grains have a $ThMn_{12}$ type crystal structure (space group I4/mmm), which is one of the present embodiment, will be specifically described. In the present embodiment, the R-T compound having a $ThMn_{12}$ type crystal structure (space group I4/mmm) will be described as a $ThMn_{12}$ type R-T compound hereinafter.

"R" in the $ThMn_{12}$ type R-T compound represents one or more kinds of rare earth elements including Ce or including Ce and Y, La, Pr, Nd, Sm, Eu, Gd, Tb, Dy, Ho, Er, Tm, Yb, and Lu. A high magnetic anisotropy can be expected by a state in which an electron is present in the 4f orbit of Ce, namely, by the expression of a trivalent state. That is, by increasing the Ce amount, it is possible to expect a high magnetic anisotropy and to increase the coercivity of the permanent magnet. Incidentally, the proportion of Ce in the entire rare earth elements is desirably greater, and the proportion of Ce is at least half or more with respect to the entire rare earth element amount.

The amount of "R" in the $ThMn_{12}$ type R-T compound is preferably 4.2 at % or more and 25.0 at % or less. When the amount of "R" is less than 4.2 at %, the generation of the main phase is not sufficient, α-Fe exhibiting soft magnetism is deposited, and the coercivity significantly decreases. On the other hand, the volume ratio of the main phase and the saturation magnetic flux density decrease when "R" exceeds 25.0 at %. It is possible to improve the saturation magnetic flux density as the amount of "R" is set to be in such a range.

"T" in the $ThMn_{12}$ type R-T compound represents one or more of transition metal elements including essentially Fe or Fe and Co or an element that is partially substituted with "M" ("M" represents one or more kinds of Ti, V, Cr, Mo, W, Zr, Hf, Nb, Ta, Al, Si, Cu, Zn, Ga, and Ge). The Co amount is desirably greater than 0 at % and 50 at % or less with respect to the total amount of "T". It is possible to improve the saturation magnetic flux density by adding Co at an appropriate amount. In addition, it is possible to improve the corrosion resistance of the rare earth permanent magnet by increasing the Co amount. The amount of "M" is desirably 0.4 at % or more and 25.0 at % or less with respect to the total amount of "T". When the amount of "M" is less than 0.4 at % with respect to the total amount of "T", $R_2Fe_{17}$ or α-Fe exhibiting soft magnetism is deposited and the volume ratio of the main phase decreases, and the saturation magnetic flux density significantly decreases when the amount of "M" exceeds 25.0 at %.

The $ThMn_{12}$ type R-T compound may contain an interstitial element "X", where "X" represents one or more kinds of elements of N, H, Be, and C. The amount of "X" is desirably 0 at % or more and 14 at % or less. It is possible to improve the coercivity as "X" intrudes into the crystal lattice. It is believed that this is because the magnetocrystalline anisotropy is improved by the interstitial element.

All of the rare earth permanent magnets according to the present embodiment are allowed to contain other elements. For example, it is possible to appropriately contain an element such as Bi, Sn, and Ag. In addition, the rare earth element may contain impurities derived from the raw material.

Hereinafter, a preferred example of the manufacturing method of the present invention will be described.

An example of the method for manufacturing a sintered magnet will be described. First, a raw material alloy from which a rare earth permanent magnet having a desired composition is obtained is prepared. The raw material alloy can be fabricated by a strip casting method or another known dissolution method in a vacuum or an inert gas atmosphere, desirably in an Ar atmosphere. In the strip casting method, the molten metal obtained by melting the raw material metal in a non-oxidizing atmosphere such as an Ar gas atmosphere is ejected onto the surface of a rotating roll. The molten metal that has been rapidly cooled on the roll is rapidly solidified into a thin plate or flake (scale) shape. This rapidly solidified alloy has a homogeneous structure having a crystal grain size of from 1 μm to 50 μm. The raw material alloy can be obtained not only by the strip casting method but also by a dissolution method such as high frequency induction melting. Incidentally, in order to prevent segregation after melting, for example, the molten metal can be solidified by being poured on a water-cooled copper plate. In addition, it is also possible to use an alloy obtained by a reduction diffusion method as a raw material alloy.

As the raw material alloy, the so-called single-alloy method to create a permanent magnet from one kind of alloy is basically applied but it is also possible to apply the so-called mixing method to use a main phase alloy (low "R" alloy) that is the main phase grains and the main constituent and an alloy (high "R" alloy) which contains "R" more than the low "R" alloy and effectively contributes to the formation of the grain boundary.

The raw material alloy is subjected to a pulverization step. In the case of the mixing method, the low "R" alloy and the high "R" alloy are pulverized separately or together. The pulverization step includes a coarse pulverization step and a fine pulverization step. First, the raw material alloy is coarsely pulverized so as to have a particle diameter of about several hundreds μm. It is desirable to conduct the coarse pulverization by using a stamp mill, a jaw crusher, a brown mill, or the like in an inert gas atmosphere. It is effective to conduct the pulverization by occluding hydrogen in the raw material alloy and then releasing the hydrogen therefrom prior to the coarse pulverization. The hydrogen release treatment is conducted for the purpose of decreasing hydrogen to be impurities of the sintered magnet. The heating and retention temperature for hydrogen occlusion is 200° C. or higher and preferably 350° C. or higher. The retention time varies depending on the relation with the retention temperature, the thickness of the raw material alloy, and the like, but it is at least 30 minutes or longer and desirably 1 hour or longer. Incidentally, the hydrogen release treatment is conducted in a vacuum or an Ar gas flow. The hydrogen occlusion treatment and the hydrogen release treatment are not essential treatments. This hydrogen pulverization can serve as the coarse pulverization so that the mechanical coarse pulverization can be omitted.

The fine pulverization step is conducted after the coarse pulverization step. For fine pulverization, jet milling is mainly used, and the coarsely pulverized powder having a particle diameter of about several hundreds m is pulverized so as to have an average particle diameter of from 2.5 μm to 6 μm and preferably from 3 μm to 5 μm. Jet milling is a method in which a high-pressure inert gas is released through a narrow nozzle to generate a high-speed gas stream, the coarsely pulverized powder is accelerated by this high-speed gas stream, and collision between the coarsely pulverized powders or collision between the coarsely pulverized powder and the target or container wall is caused so that the coarsely pulverized powder is pulverized.

For fine pulverization, wet pulverization may be used. For wet pulverization, a ball mill, wet attritor, and the like are used, the coarsely pulverized powder having a particle diameter of about several hundreds μm is pulverized so as to have an average particle diameter of from 1.5 μm to 5 μm and desirably from 2 μm to 4.5 μm. In wet pulverization, the magnet powder is pulverized without being touched to oxygen by selecting an appropriate dispersion medium, and thus a powder having a low oxygen concentration is obtained.

For the purpose of improving lubrication and orientation at the time of molding, it is possible to add a fatty acid or any derivative of a fatty acid or a hydrocarbon, for example, zinc stearate, calcium stearate, aluminum stearate, stearic acid amide, oleic acid amide, or ethylene bis-isostearic acid amide which is stearic acid-based one or oleic acid-based one or paraffin or naphthalene which is a hydrocarbon at about 0.01 wt % to 0.3 wt % at the time of fine pulverization.

The finely pulverized powder is subjected to molding in a magnetic field. The molding pressure when molding in a magnetic field may be set to be in a range of from 0.3 ton/cm$^2$ to 3 ton/cm$^2$ (30 MPa to 300 MPa). The molding pressure may be constant from the start to the end of molding, it may be gradually increased or gradually decreased, or it may be irregularly changed. The orientation is more favorable as the molding pressure is lower, but the strength of the molded body is insufficient so as to cause a problem in handling when the molding pressure is too low, and thus the molding pressure is selected from the above range in consideration of this point. The final relative density of the molded body obtained by molding in a magnetic field is usually from 40% to 60%.

The magnetic field to be applied may be about from 960 kA/m to 1600 kA/m. The magnetic field to be applied is not limited to a static magnetic field, and it may be a pulsed magnetic field. In addition, it is also possible to concurrently use a static magnetic field and a pulsed magnetic field.

The molded body is subjected to a sintering step. Sintering is conducted in a vacuum or an inert gas atmosphere. The temperature and time for sintering retention are required to be adjusted depending on the conditions such as the crystal structure, the composition, the pulverization method, and the difference between average particle diameter and grain size distribution, but sintering is conducted at about from 700° C. to 1200° C. for 20 hours or longer and the temperature is lowered after the appropriate retention time elapsed. At the time of the sintering step described above, it is effective to apply a pressure of from 2.0 GPa to 5.0 GPa in the direction perpendicular to the easy axis since the difference in the shrinkage rate between the orientation direction and the perpendicular direction increases. The present inventors believe that the distance between Ce and the adjacent atom contained in the composition changes in this manner, and thus the trivalent Ce state is structurally most stable and a high magnetic anisotropy of Ce which is a feature of the present invention is expressed.

The sintered body obtained after sintering can be subjected to an aging treatment.

Next, an example of the method for manufacturing a bonded magnet will be described. First, the sintered body obtained by the method for manufacturing a sintered magnet is pulverized. The method described in [0048], [0049], and [0050] can be applied to the pulverization step.

In a case in which the interstitial element "X" is N, H etc., a nitriding treatment or a hydrogenation treatment can be conducted at this stage. The present sintered body powder is subjected to a heat treatment for from 0.1 hour to 100 hours at a temperature of from 200° C. to 1000° C. in a nitrogen gas or hydrogen gas at from 0.001 atm to 10 atm. As the atmosphere for the heat treatment, a nitrogen gas may be mixed with a hydrogen gas, and a nitrogen compound gas such as ammonia may be further used.

Thereafter, a resin binder containing a resin and the present sintered body powder are kneaded, for example, by a pressure kneader to prepare a compound (composition) for bonded magnet containing a resin binder and the present sintered body powder. As the resin, there are a thermosetting resin such as an epoxy resin or a phenol resin and a thermoplastic resin such as a styrene-based, an olefin-based, a urethane-based, a polyester-based, or a polyamide-based elastomer or ionomer, an ethylene-propylene copolymer (EPM), or an ethylene-ethyl acrylate copolymer. Among them, a thermosetting resin is preferable and an epoxy resin or a phenol resin is more preferable as the resin used in the case of compression molding. In addition, a thermoplastic resin is preferable as the resin used in the case of injection molding. In addition, a coupling agent or another additive may be added to the compound for bonded magnet if necessary.

In addition, as the content ratio of the present sintered body powder to the resin in the bonded magnet, the resin is preferably contained, for example, at 0.5 wt % or more and 20 wt % or less with respect to 100 wt % of the present sintered body powder. There is a tendency that the shape retaining property is impaired when the amount of resin is less than 0.5 wt % with respect to 100 wt % of the present sintered body powder, and there is a tendency that it is difficult to obtain sufficiently excellent magnetic properties when resin exceeds 20 wt %.

After a compound for bonded magnet described above is prepared, it is possible to obtain a bonded magnet containing the present sintered body powder and a resin by subjecting this compound for bonded magnet to injection molding. In the case of fabricating a bonded magnet by injection molding, the compound for bonded magnet is heated if necessary to the melting temperature of the binder (thermoplastic resin) so as to be in a fluidized state, and this compound for bonded magnet is then injected into a mold having a predetermined shape to conduct molding. Thereafter, the compound for bonded magnet is cooled, and a molded article (bonded magnet) having a predetermined shape is taken out from the mold. A bonded magnet is obtained in this manner. The method for manufacturing a bonded magnet is not limited to the method by injection molding described above, and for example, a bonded magnet containing the present sintered body powder and a resin may be obtained by subjecting a compound for bonded magnet to compression molding. In the case of fabricating a bonded magnet by compression molding, the compound for bonded magnet described above is prepared, this compound for bonded magnet is then filled in a mold having a predetermined shape, a molded article (bonded magnet) having a predetermined shape is taken out from the mold by applying a pressure thereto. A compression molding machine such as a mechanical press or a hydraulic press is used when a compound for bonded magnet is molded in a mold and taken out therefrom. Thereafter, the molded article is cured by being introduced into a furnace such as a heating furnace or a vacuum drying furnace and heated, whereby a bonded magnet is obtained.

The shape of the bonded magnet obtained by molding is not particularly limited, for example, there are a flat shape, a columnar shape, or a ring shape as a cross-sectional shape according to the shape of the mold to be used, and the shape can be changed according to the shape of the bonded magnet. In addition, the bonded magnet thus obtained may be subjected to plating or coating in order to prevent deterioration of the oxidized layer or resin layer on its surface.

The molded article obtained by applying a magnetic field and molding may be oriented in a certain direction when the compound for bonded magnet is molded into the intended predetermined shape. This allows the bonded magnet to orient in a specific direction, and thus an anisotropic bonded magnet exhibiting stronger magnetism is obtained.

The embodiment related to the manufacturing method for suitably implementing the present invention has been described above, but subsequently, the method for analyzing the composition and Ce valence in the main phase grains of the rare earth permanent magnet of the present invention will be described.

It is possible to determine the composition in the main phase grains by energy dispersive X-ray spectroscopy (EDS). It is confirmed that the main generated phase is attributed to the aimed crystal structure by X-ray diffractometry (XRD) of the sintered magnet or bonded magnet that is a sample, the sintered magnet or the bonded magnet is then processed into a flake shape having a thickness of 100 nm by using a focused ion beam (FIB) device, the vicinity of the center of the main phase grains is analyzed by using an EDS device equipped to a scanning transmission electron microscope (STEM), and the composition of the main phase grains can be quantified by using the thin film compensation function. It can be complemented by an infrared absorption method or mass spectrometry in a case in which there is an element that is hardly detected by using an EDS device.

It is possible to determine the abundance ratio C3/(C3+C4) in the main phase grains where CT denotes the number of Ce atoms, C3 denotes the number of trivalent. Ce atoms, and C4 denotes the number of tetravalent Ce atoms by using a device for electron energy loss spectroscopy (EELS) equipped to a STEM.

The observable position of the main phase grains is adjusted in a STEM, the accelerating voltage is set to 300 kV, and the observation position is irradiated with an electron beam, whereby an EELS spectrum is obtained. In the FIGURE, the EELS spectrum for $Ce_2Fe_{14}B$ that is the composition of the main phase grains and the EELS spectra of the standard samples $CeO_2$ and $CePO_4$ are illustrated. The standard samples $CeO_2$ and $CePO_4$ are an ionic crystal, and the valence of Ce in them is tetravalent and trivalent, respectively. It is possible to calculate the abundance ratio C3/(C3+C4) in the main-phase particles by using the EELS spectra of these standard samples.

It is possible to calculate C3/(C3+C4) from the EELS spectra illustrated in the FIGURE by defining the ratio of M4 peak to M5 peak for each of the standard samples $CeO_2$ and $CePO_4$ as M4(4+)/M5(4+) and M4(3+)/M5(3+) and the ratio of M4 peak to M5 peak in the spectrum for the main phase grains as M4/M5 and comparing with each other by using [Mathematical formula 1] and [Mathematical formula 2].

$$M4/M5=C4/(C3+C4)\times M4(4+)/M5(4+)+C3/(C3+C4)\times M4(3+)/M5(3+) \quad \text{[Mathematical formula 1]}$$

$$C3+C4=CT \quad \text{[Mathematical formula 2]}$$

EXAMPLES

Examples of an R-T-X compound of which the main phase grains have a $Nd_2Fe_{14}B$ type crystal structure (space group $P4_2/mnm$) will be described. Hereinafter, the present invention will be more specifically described with reference to Examples and Comparative Examples, but the present invention is not limited to the following Examples in any way.

Examples 1 to 15 and Comparative Examples 1 to 10

Predetermined amounts of a Ce metal, a R1 metal, a Fe metal, X1, and X2 were weighed so that the main phase grains had a composition of $(Ce_{1-z}R1_z)_2Fe_{14}(X1_{1-w}X2_w)$ (R1=Y, Gd, Nd, or Dy, $0\leq z\leq 0.75$, X1 and X2=B, Be, C, or Si, $0\leq w\leq 0.1$), and a thin plate-shaped Ce—R1-Fe—X1-X2 alloy was fabricated by a strip casting method. This alloy was subjected to a heat treatment while being stirred in a hydrogen stream to be formed into a coarse powder, oleic acid amide as a lubricant was then added thereto, the coarse powder was formed into a fine powder (average particle diameter: 3 μm) in a non-oxidizing atmosphere by using a jet mill. The fine powder thus obtained was filled in a mold (opening size: 20 mm×18 mm) and subjected to uniaxial pressure molding at a pressure of 2.0 ton/cm$^2$ while applying a magnetic field of 1600 kA/m in the perpendicular direction to the pressurizing direction. The molded body thus obtained was heated up to the optimal sintering temperature, retained for from 15 hours to 30 hours at a sintering temperature of from 700° C. to 1200° C. while applying a pressure of from 3.0 GPa to 10.0 GPa in the direction perpendicular to the easy axis, then cooled to room temperature, subsequently subjected to the aging treatments for 1 hour at 800° C. and for 1 hour at 600° C., thereby obtaining a sintered magnet. The manufacturing conditions in the respective Examples and Comparative Examples and the magnetic properties of the sintered magnets measured by using a BH tracer are presented in Table 1.

The sintered magnet thus obtained was cut perpendicularly to the direction in which a magnetic field was applied at the time of molding and which was the axis of easy magnetization, and it was confirmed that the main generated phase was attributed to the $Nd_2Fe_{14}B$ type crystal structure (space group $P4_2/mnm$) by XRD. Subsequently, the sintered magnet was processed into a flake shape having a thickness of 100 nm by using a FIB device, the vicinity of the center of the main phase grains was analyzed by using an EDS device equipped to a STEM, and the composition of the main phase grains was quantified by using the thin film compensation function. Incidentally, it is difficult to use an EDS device for the quantification of B since it exhibits low sensitivity to a light element. Hence, the composition of the main phase grains was determined by the composition ratio of elements other than B based on the fact that the main generated phase was the $Nd_2Fe_{14}B$ type crystal structure (space group $P4_2/mnm$) confirmed by XRD in advance. Subsequently, the observable position of the main phase grains was adjusted in the STEM, and the EELS spectra were obtained. The compositions of the respective main phase grains and C3/(C3+C4) calculated from the EELS spectra are presented in Table 1.

The sintered magnet was corroded by using a testing machine for a pressure cooker test (PCT) under the conditions of 120° C., 2 atm, 100% RH, and 200 hours, the corrosion on the surface of the sintered magnet was then removed, the weight change rate of the sintered magnet was determined, and the results are presented in Table 1.

In addition, the predicted value of the coercivity HcJ in a case in which Ce was in a tetravalent state was calculated for the compositions of the respective main phase grains. For the calculation, a sintered magnet was fabricated under the following conditions. The sintering pressure was not applied but other fabricating conditions were the same as those in Example 1 so that the compositions of the main phase grains were $Ce_2Fe_{14}B$, $Nd_2Fe_{14}B$, $Y_2Fe_{14}B$, $Gd_2Fe_{14}B$, and $Dy_2Fe_{14}B$. The valence of Ce in the $Ce_2Fe_{14}B$ sintered magnet thus fabricated was evaluated by the same method as in [0072]. As a result, C3/(C3+C4) was less than 0.1, that is, a tetravalent state was dominant.

The predicted value of the coercivity HcJ corresponding to the composition of main phase grains in Examples 5 to 10 and Comparative Examples 4 and 5 was calculated by using the results of coercivity HcJ for these sintered magnets measured by using a BH tracer. For the calculation, it was presumed that the composition of main phase grains and the coercivity HcJ linearly corresponded to each other and [Mathematical formula 3] was used. Here, the composition of main phase grains is defined as $(Ce_{1-z}R1_z)_2Fe_{14}B$, the coercivity HcJ of $Ce_2Fe_{14}B$ is defined as HcJ (Ce), and the coercivity HcJ of $R1_2Fe_{14}B$ is defined as HcJ (R1). The results of this calculation are presented in Table 1 as HcJ (predicted value from composition) in a case in which Ce in a tetravalent state is dominant.

$$\text{HcJ(predicted value from composition)}=(1-z)\times\text{HcJ(Ce)}+z\times\text{HcJ(R1)} \quad \text{[Mathematical formula 3]}$$

Examples 1 to 4 and Comparative Examples 1 to 3

In $(Ce_{1-z}R1_z)_2Fe_{14}(X1_{1-w}X2_w)$ (z=0, X1=B, X2=Be, C, or Si, 0.0≤w≤0.1), a coercivity HcJ equivalent to that in a case in which the total amount of "X" was B was obtained and C3/(C3+C4) was also a great value when the proportion of B in "X" is greater. On the other hand, the coercivity HcJ was significantly small and C3/(C3+C4) was also a small value in a case in which the total amount of "X" was an element (Be, Ce, or Si) other than B. From this fact, it can be seen that a high coercivity due to trivalent Ce is obtained even when part of B in "X" is an element (Be, C, or Si) other than B.

Examples 1 and 5 to 8 and Comparative Examples 4 and 5

In $(Ce_{1-z}R1_z)_2Fe_{14}(X1_{1-w}X2_w)$ (R1=Y or Gd, 0≤z<0.75, X1=B, w=0), C3/(C3+C4) is higher as the amount "z" substituted with R1 is smaller, that is, the Ce amount is greater, and the coercivity HcJ is a value greater than the value predicted from the composition ratio of Ce and R1. However, C3/(C3+C4) and the value of coercivity HcJ both significantly decreased in a case in which z=0.75 (Comparative Examples 4 and 5). From this fact, it can be seen that a change in Ce valence state contributes to the magnetic anisotropy in the main phase and it is responsible for a more increase in coercivity than predicted from the composition ratio of Ce and R1.

Examples 6 and 8 to 10

In $(Ce_{1-z}R1_z)_2Fe_4(X1_{1-w}X2_w)$ (R1=Y, Gd, Nd, or Dy, z=0.5, X1=B, w=0), a trivalent Ce state was confirmed for any R1 element, the coercivity HcJ had a value greater than the value predicted from the composition ratio of Ce and R1. From this fact, it can be seen that a permanent magnet having a high magnetic anisotropy is obtained regardless of the R1 element when Ce is contained therein.

Examples 1, 11, and 12 and Comparative Example 6

For $Ce_2Fe_{14}B$, only the sintering temperature was changed between 780° C. and 1200° C. In a case in which the sintering temperature was from 800° C. to 1200° C. (Examples 1, 11, and 12), C3/(C3+C4) was high and the coercivity HcJ also had a high value, but C3/(C3+C4) was low and the coercivity HcJ also decreased in a case in which the sintering temperature was 780° C. (Comparative Example 6). It can be seen that a high coercivity is expressed in the main phase grains as the shrinkage rate changes depending on the sintering temperature and a trivalent Ce state is stabilized.

Examples 1, 13, and 14 and Comparative Example 7

For $Ce_2Fe_{14}B$, only the sintering time was changed between 15 h and 30 h. In a case in which the sintering time was 20 h or longer (Examples 1, 13, and 14), both C3/(C3+C4) and the coercivity HcJ had a high value, and both C3/(C3+C4) and the coercivity HcJ increased along with an increase in sintering time. On the other hand, both C3/(C3+C4) and the coercivity HcJ had a lower value in a case in which the sintering time was 15 h (Comparative Example 7) as compared to the case in which the sintering time was 20 h or longer. From this fact, it can be seen that the difference in shrinkage rate is remarkable by a sufficient sintering time, the stabilization of a trivalent Ce state is promoted, and the main phase grains has a higher coercivity.

Examples 1 and 15 and Comparative Examples 9 and 10

For $Ce_2Fe_{14}B$, only the sintering pressure was changed between 3.0 GPa and 10.0 GPa. In a case in which the sintering pressure was from 3.0 GPa to 5.0 GPa (Examples 1 and 15), both C3/(C3+C4) and the coercivity HcJ had a high value, both C3/(C3+C4) and the coercivity HcJ tended to increase along with an increase in sintering pressure. On the other hand, in a case in which the sintering pressure was 6.0 GPa or more (Comparative Examples 9 and 10), C3/(C3+C4) increased to be more than 0.5 but the coercivity HcJ was not greatly changed, and the weight change rate measured by the PCT test was significantly great. From this fact, it can be seen that the abundance of Ce in a trivalent state to be easily oxidized increases, and the corrosion resistance significantly decreases in a case in which C3/(C3+C4) increases to be more than 0.5. In addition, a case in which the sintering pressure was not applied or a case in which 3.0 GPa was isotropically applied was also investigated, but C3/(C3+C4) was less than 0.1 and a high coercivity was not obtained in both cases.

TABLE 1

| | Composition of main phase grains | Sintering temperature ° C. | Sintering time h | Sintering pressure GPa | Br mT | HcJ kA/m | HcJ (predicted value from composition) kA/m | C3/(C3 + C4) | Weight change rate % |
|---|---|---|---|---|---|---|---|---|---|
| Example 1 | $Ce_2Fe_{14}B$ | 1000 | 20 | 3.0 | 885 | 631 | — | 0.47 | −0.29 |
| Example 2 | $Ce_2Fe_{14}B_{0.9}Be_{0.1}$ | 1000 | 20 | 3.0 | 674 | 566 | — | 0.33 | −0.20 |
| Example 3 | $Ce_2Fe_{14}B_{0.9}C_{0.1}$ | 1000 | 20 | 3.0 | 796 | 594 | — | 0.38 | −0.23 |
| Example 4 | $Ce_2Fe_{14}B_{0.9}Si_{0.1}$ | 1000 | 20 | 3.0 | 705 | 579 | — | 0.35 | −0.21 |
| Example 5 | $(Ce_{0.75}Y_{0.25})_2Fe_{14}B$ | 1000 | 20 | 3.0 | 932 | 489 | 394 | 0.32 | −0.20 |
| Example 6 | $(Ce_{0.50}Y_{0.50})_2Fe_{14}B$ | 1000 | 20 | 3.0 | 979 | 387 | 358 | 0.16 | −0.10 |
| Example 7 | $(Ce_{0.75}Gd_{0.25})_2Fe_{14}B$ | 1000 | 20 | 3.0 | 832 | 466 | 373 | 0.33 | −0.20 |
| Example 8 | $(Ce_{0.50}Gd_{0.50})_2Fe_{14}B$ | 1000 | 20 | 3.0 | 780 | 356 | 316 | 0.18 | −0.11 |
| Example 9 | $(Ce_{0.50}Nd_{0.50})_2Fe_{14}B$ | 1000 | 20 | 3.0 | 1047 | 775 | 695 | 0.23 | −0.14 |
| Example 10 | $(Ce_{0.50}Dy_{0.50})_2Fe_{14}B$ | 1000 | 20 | 3.0 | 941 | 1452 | 1291 | 0.25 | −0.15 |
| Example 11 | $Ce_2Fe_{14}B$ | 800 | 20 | 3.0 | 831 | 577 | — | 0.34 | −0.20 |
| Example 12 | $Ce_2Fe_{14}B$ | 1200 | 20 | 3.0 | 867 | 598 | — | 0.39 | −0.23 |
| Example 13 | $Ce_2Fe_{14}B$ | 1000 | 25 | 3.0 | 879 | 628 | — | 0.46 | −0.28 |
| Example 14 | $Ce_2Fe_{14}B$ | 1000 | 30 | 3.0 | 889 | 637 | — | 0.48 | −0.29 |
| Example 15 | $Ce_2Fe_{14}B$ | 1000 | 20 | 5.0 | 898 | 642 | — | 0.49 | −0.29 |
| Comp. Example 1 | $Ce_2Fe_{14}Be$ | 1000 | 20 | 3.0 | 527 | 202 | — | 0.06 | — |
| Comp. Example 2 | $Ce_2Fe_{14}C$ | 1000 | 20 | 3.0 | 659 | 269 | — | 0.08 | — |
| Comp. Example 3 | $Ce_2Fe_{14}Si$ | 1000 | 20 | 3.0 | 791 | 236 | — | 0.07 | — |
| Comp. Example 4 | $(Ce_{0.25}Y_{0.75})_2Fe_{14}B$ | 1000 | 20 | 3.0 | 1027 | 329 | 322 | 0.08 | — |
| Comp. Example 5 | $(Ce_{0.25}Gd_{0.75})_2Fe_{14}B$ | 1000 | 20 | 3.0 | 728 | 263 | 259 | 0.07 | — |
| Comp. Example 6 | $Ce_2Fe_{14}B$ | 780 | 20 | 3.0 | 169 | 102 | — | 0.09 | — |
| Comp. Example 7 | $Ce_2Fe_{14}B$ | 1000 | 15 | 3.0 | 141 | 101 | — | 0.08 | — |
| Comp. Example 8 | $Ce_2Fe_{14}B$ | 700 | 30 | 3.0 | 132 | 94 | — | 0.07 | — |
| Comp. Example 9 | $Ce_2Fe_{14}B$ | 1000 | 20 | 6.0 | 891 | 638 | | 0.53 | −2.30 |
| Comp. Example 10 | $Ce_2Fe_{14}B$ | 1000 | 20 | 10.0 | 893 | 636 | — | 0.56 | −2.70 |

Example 14 and Comparative Example 8

For $Ce_2Fe_{14}B$, the sintering time was 30 h and only the sintering temperature was changed to 700° C. and 1000° C. In a case in which the sintering temperature was 700° C. (Comparative Example 8), both C3/(C3+C4) and the coercivity HcJ significantly decreased as compared to a case in which the sintering temperature was 1000° C. (Example 14). From this fact, it can be seen that a change in shrinkage rate occurs by a sufficient sintering temperature and a sufficient sintering time, a trivalent Ce state is stabilized in the main phase grains, and an increase in the coercivity occurs.

Subsequently, Examples of a R-T compound of which the main phase grains have a $TbCu_7$ type crystal structure (space group P6/mmm) will be described. Hereinafter, the present invention will be more specifically described with reference to Examples and Comparative Examples, but the present invention is not limited to the following Examples in any way.

Examples 16 to 22 and Comparative Examples 11 to 16

Predetermined amounts of a Ce metal and Fe metal were weighed so that the main phase grains had a composition of $CeFe_7$, and a thin plate-shaped Ce—Fe alloy was fabricated by a strip casting method. This alloy was subjected to a heat treatment while being stirred in a hydrogen stream to be formed into a coarse powder, oleic acid amide as a lubricant was then added thereto, the coarse powder was formed into a fine powder (average particle diameter: 3 μm) in a non-oxidizing atmosphere by using a jet mill. The fine powder thus obtained was filled in a mold (opening size: 20 mm×18 mm) and subjected to uniaxial pressure molding at a pressure of 2.0 ton/$cm^2$ while applying a magnetic field of 1600 kA/m in the perpendicular direction to the pressurizing direction. The molded body thus obtained was heated up to the optimal sintering temperature, retained for from 15 hours to 30 hours at a sintering temperature of from 600° C. to 900° C. while applying a pressure of from 1.0 GPa to 10.0 GPa in the direction perpendicular to the easy axis, then cooled to room temperature, subsequently subjected to the aging treatment for 1 hour at 600° C., thereby obtaining a sintered magnet. The manufacturing conditions in the respective Examples and Comparative Examples are presented in Table 2.

The magnetic properties of the sintered magnet thus obtained were measured by using a BH tracer and applying a magnetic field off 5600 kA/m in the easy axis direction. Incidentally, the magnetic flux density was confirmed to be within a range of ±5% at the time of applying +4800 kA/m and +5600 kA/mT, and the value at the time of applying +5600 kA/m was adopted as the saturation magnetic flux density. The saturation magnetic flux density and coercivity HcJ measured in this manner are presented in Table 2.

It was confirmed that the main generated phase of the sintered magnet thus obtained was attributed to the $TbCu_7$ type crystal structure (space group P6/mmm) by XRD. Subsequently, the sintered magnet was processed into a flake shape having a thickness of 100 nm by using a FIB device, the vicinity of the center of the main phase grains was analyzed by using an EDS device equipped to a STEM, and the composition of the main phase grains was quantified. Subsequently, the observable position of the main phase grains was adjusted in the STEM, and the EELS spectra were obtained. The compositions of the respective main phase grains and C3/(C3+C4) calculated from the EELS spectra are presented in Table 2.

The sintered magnet was corroded by using a testing machine for a PCT under the conditions of 120° C., 2 atm, 100% RH, and 200 hours, the corrosion on the surface of the sintered magnet was then removed, the weight change rate of the sintered magnet was determined. The results are presented in Table 2.

Examples 16 to 18 and Comparative Example 11

For $CeFe_7$, only the sintering temperature was changed between 650° C. and 900° C. In a case in which the sintering temperature was from 700° C. to 900° C. (Examples 16 to 18), C3/(C3+C4) was high and the coercivity HcJ also had a high value, but C3/(C3+C4) was low and the coercivity HcJ also decreased in a case in which the sintering temperature was 650° C. (Comparative Example 11). It can be seen that a high coercivity is expressed in the main phase grains as the shrinkage rate changes depending on the sintering temperature and a trivalent Ce state is stabilized.

Examples 16, 19, and 20 and Comparative Example 12

For $CeFe_7$, only the sintering time was changed between 15 h and 30 h. In a case in which the sintering time was 20 h or longer (Examples 16, 19, and 20), both C3/(C3+C4) and the coercivity HcJ had a high value, but both C3/(C3+C4) and the coercivity HcJ exhibited a behavior of being saturated even when the sintering time was increased. On the other hand, both C3/(C3+C4) and the coercivity HcJ had a lower value in a case in which the sintering time was 15 h (Comparative Example 12) as compared to the case in which the sintering time was 20 h or longer. From this fact, it can be seen that the difference in shrinkage rate is remarkable by a sufficient sintering time, the stabilization of a trivalent Ce state is promoted, and the main phase grains has a higher coercivity.

Example 20 and Comparative Example 13

For $CeFe_7$, the sintering time was 30 h and only the sintering temperature was changed to 600° C. and 800° C. In a case in which the sintering temperature was 600° C. (Comparative Example 13), both C3/(C3+C4) and the coercivity HcJ significantly decreased as compared to a case in which the sintering temperature was 800° C. (Example 20). From this fact, it can be seen that a change in shrinkage rate occurs by a sufficient sintering temperature and a sufficient sintering time, a trivalent Ce state is stabilized in the main phase grains, and an increase in the coercivity occurs.

Examples 16, 21 and 22 and Comparative Examples 14 to 16

For $CeFe_7$, only the sintering pressure was changed between 1.0 GPa and 10.0 GPa. In a case in which the

TABLE 2

| | Composition of main phase grains | Sintering temperature ° C. | Sintering time h | Sintering pressure GPa | Saturation magnetic flux density mT | HcJ kA/m | C3/(C3 + C4) | Weight change rate % |
|---|---|---|---|---|---|---|---|---|
| Example 16 | $CeFe_7$ | 800 | 20 | 3.0 | 1437 | 438 | 0.45 | −0.20 |
| Example 17 | $CeFe_7$ | 700 | 20 | 3.0 | 1349 | 400 | 0.32 | −0.15 |
| Example 18 | $CeFe_7$ | 900 | 20 | 3.0 | 1408 | 415 | 0.39 | −0.17 |
| Example 19 | $CeFe_7$ | 800 | 25 | 3.0 | 1427 | 436 | 0.44 | −0.19 |
| Example 20 | $CeFe_7$ | 800 | 30 | 3.0 | 1420 | 470 | 0.43 | −0.19 |
| Example 21 | $CeFe_7$ | 800 | 20 | 5.0 | 1458 | 445 | 0.48 | −0.20 |
| Example 22 | $CeFe_7$ | 800 | 20 | 2.0 | 1325 | 320 | 0.18 | — |
| Comp. Example 11 | $CeFe_7$ | 650 | 20 | 3.0 | 1289 | 71 | 0.09 | — |
| Comp. Example 12 | $CeFe_7$ | 800 | 15 | 3.0 | 1301 | 70 | 0.08 | — |
| Comp. Example 13 | $CeFe_7$ | 600 | 30 | 3.0 | 1250 | 65 | 0.06 | — |
| Comp. Example 14 | $CeFe_7$ | 800 | 20 | 6.0 | 1447 | 443 | 0.54 | −1.90 |
| Comp. Example 15 | $CeFe_7$ | 800 | 20 | 10.0 | 1450 | 441 | 0.57 | −2.10 |
| Comp. Example 16 | $CeFe_7$ | 800 | 20 | 1.0 | 1303 | 72 | 0.08 | — |

sintering pressure was from 2.0 GPa to 5.0 GPa (Examples 16, 21 and 22), both C3/(C3+C4) and the coercivity HcJ had a high value, both C3/(C3+C4) and the coercivity HcJ tended to increase along with an increase in sintering pressure. On the other hand, in a case in which the sintering pressure was 6.0 GPa or more (Comparative Examples 14 and 15), C3/(C3+C4) increased to be more than 0.5 but the coercivity HcJ was not greatly changed, and the weight change rate measured by the PCT test was significantly great. From this fact, it can be seen that the abundance of Ce in a trivalent state to be easily oxidized increases, and the corrosion resistance significantly decreases in a case in which C3/(C3+C4) increases to be more than 0.5. In addition, a case in which the sintering pressure was not applied or a case in which 3.0 GPa was isotropically applied was also investigated, but C3/(C3+C4) was less than 0.1 and a high coercivity was not obtained in both cases.

Examples 23 to 32 and Comparative Examples 17 and 18

Predetermined amounts of a Ce metal, a R2 metal, and a Fe metal were weighed so that the main phase grains had a composition of $(Ce_{1-p}R2_p)Fe_7$ (R2=Y, Gd, Nd, Dy, or any of them partially substituted with Zr, $0 \leq p \leq 0.75$), and a thin plate-shaped Ce-R2-Fe alloy was fabricated by a strip casting method. A sintered body was obtained from this alloy by the same method as in [0085]. However, the conditions for manufacturing the sintered body which correspond to the respective Examples and Comparative Examples are as described in Table 3. Furthermore, this sintered body was subjected to a heat treatment while being stirred in a hydrogen stream to be formed into a coarse powder, oleic acid amide as a lubricant was then added thereto, the coarse powder was formed into a fine powder (average particle diameter: 3 μm) in a non-oxidizing atmosphere by using a jet mill. If necessary, this fine powder was subjected to a heat treatment for 10 hours at a temperature of 400° C. in a nitrogen gas or hydrogen gas at 1 atm. Thereafter, the fine powder and paraffin were packed in a case, and the fine powder was oriented by applying a magnetic field of 1600 kA/m in a state in which the paraffin was molten, thereby molding a bonded magnet.

The bonded magnet thus obtained was subjected to the evaluation by a BH tracer, XRD, EDS, EELS, and PCT under the same conditions as those for the sintered magnet of a $TbCu_7$ type R-T compound described above. Incidentally, the composition of the main phase grains was calculated in consideration of the results obtained by the infrared absorption method in a case in which the main phase grains contained an interstitial element "X". The results are presented in Table 3.

In addition, the predicted value of the coercivity HcJ in a case in which Ce was in a tetravalent state was calculated for the compositions of the respective main phase grains. For the calculation, a bonded magnet was fabricated under the following conditions. The sintering pressure was not applied but other fabricating conditions were the same as those in Example 24 so that the compositions of the main phase grains were $CeFe_7N_{0.6}$, $YFe_7N_{0.6}$, $GdFe_7N_{0.6}$, $NdFe_7N_{0.6}$, and $DyFe_7N_{0.6}$. The valence of Ce in the $CeFe_7N_{0.6}$ bonded magnet thus fabricated was evaluated by the same method as in [0087]. As a result, C3/(C3+C4) was less than 0.1, that is, a tetravalent state was dominant.

The predicted value of the coercivity HcJ corresponding to the composition of main phase grains in Examples 26 to 31 and Comparative Examples 17 and 18 was calculated by using the results of coercivity HcJ for these bonded magnets measured by using a BH tracer. For the calculation, it was presumed that the composition of main phase grains and the coercivity HcJ linearly corresponded to each other and [Mathematical formula 4] was used. Here, the composition of main phase grains is defined as $(Ce_{1-p}R2_p)Fe_7N_{0.6}$, the coercivity HcJ of $CeFe_7N_{0.6}$ is defined as HcJ (Ce), and the coercivity HcJ of $R2Fe_7N_{0.6}$ is defined as HcJ (R2). The results of this calculation are presented in Table 3 as HcJ (predicted value from composition) in a case in which Ce in a tetravalent state is dominant.

$$HcJ(\text{predicted value from composition}) = (1-p) \times HcJ(Ce) + p \times HcJ(R2) \quad \text{[Mathematical formula 4]}$$

TABLE 3

| | Composition of main phase grains | Sintering temperature ° C. | Sintering time h | Sintering pressure GPa | Saturation magnetic flux density mT | HcJ kA/m | HcJ (predicted value from composition) kA/m | C3/(C3 + C4) | Weight change rate % |
|---|---|---|---|---|---|---|---|---|---|
| Example 23 | $CeFe_7$ | 800 | 20 | 3.0 | 1320 | 440 | — | 0.45 | −0.20 |
| Example 24 | $CeFe_7N_{0.6}$ | 800 | 20 | 3.0 | 1293 | 518 | — | 0.45 | −0.20 |
| Example 25 | $CeFe_7H_{0.6}$ | 800 | 20 | 3.0 | 1163 | 488 | — | 0.39 | −0.19 |
| Example 26 | $(Ce_{0.75}Y_{0.25})Fe_7N_{0.6}$ | 800 | 20 | 3.0 | 1343 | 402 | 305 | 0.34 | −0.15 |
| Example 27 | $(Ce_{0.50}Y_{0.50})Fe_7N_{0.6}$ | 800 | 20 | 3.0 | 1390 | 301 | 260 | 0.24 | −0.11 |
| Example 28 | $(Ce_{0.75}Gd_{0.25})Fe_7N_{0.6}$ | 800 | 20 | 3.0 | 1241 | 377 | 280 | 0.33 | −0.14 |
| Example 29 | $(Ce_{0.50}Gd_{0.50})Fe_7N_{0.6}$ | 800 | 20 | 3.0 | 1192 | 275 | 226 | 0.23 | −0.11 |
| Example 30 | $(Ce_{0.50}Nd_{0.50})Fe_7N_{0.6}$ | 800 | 20 | 3.0 | 1530 | 637 | 554 | 0.24 | −0.11 |
| Example 31 | $(Ce_{0.50}Dy_{0.50})Fe_7N_{0.6}$ | 800 | 20 | 3.0 | 1399 | 1275 | 1129 | 0.24 | −0.11 |
| Example 32 | $(Ce_{0.45}Nd_{0.45}Zr_{0.1})Fe_7N_{0.6}$ | 800 | 20 | 3.0 | 1550 | 633 | — | 0.24 | −0.10 |
| Comp. Example 17 | $(Ce_{0.25}Y_{0.75})Fe_7N_{0.6}$ | 800 | 20 | 3.0 | 1439 | 209 | 210 | 0.08 | — |
| Comp. Example 18 | $(Ce_{0.25}Gd_{0.75})Fe_7N_{0.6}$ | 800 | 20 | 3.0 | 1146 | 189 | 191 | 0.08 | — |

Examples 16 and 23

For $CeFe_7$, a sintered magnet and a bonded magnet were fabricated. In both cases of a sintered magnet (Example 16) and a bonded magnet (Example 23), C3/(C3+C4) was high and the coercivity HcJ also had a high value. From this fact, it can be seen that a high coercivity due to trivalent Ce is obtained in both of a sintered magnet and a bonded magnet.

Examples 23 to 25

For $CeFe_7$, a bonded magnet subjected to a nitriding treatment before being bonded and a bonded magnet subjected to a hydrogenation treatment before being bonded were fabricated. In both cases of a bonded magnet subjected to a nitriding treatment (Example 24) and a bonded magnet subjected to a hydrogenation treatment (Example 25), C3/(C3+C4) was high and the coercivity HcJ also had a high value. From this fact, it can be seen that a high coercivity due to trivalent Ce is obtained even after an interstitial element "X" is introduced. Furthermore, it can be seen that the coercivity is improved by introducing an interstitial element "X" as compared to a case in which an interstitial element "X" is not introduced (Example 23).

Examples 24 and 26 to 29 and Comparative Examples 17 and 18

In $(Ce_{1-p}R2_p)Fe_7X3_q$ (R2=Y or Gd, 0≤p<0.75, X3=N, q=0.6), C3/(C3+C4) is higher as the amount "p" substituted with R2 is smaller, that is, the Ce amount is greater, and the coercivity HcJ is a value greater than the value predicted from the composition ratio of the rare earth elements. However, C3/(C3+C4) and the value of coercivity HcJ both significantly decreased in a case in which p=0.75 (Comparative Examples 17 and 18). From this fact, it can be seen that a change in Ce valence state contributes to the magnetic anisotropy in the main phase and it is responsible for an increase in coercivity to HcJ (predicted value from composition) or more.

Examples 27 and 29 to 31

In $(Ce_{1-p}R2_p)Fe_7X3_q$ (R2=Y, Gd, Nd, or Dy, p=0.5, X3=N, q=0.6), a trivalent Ce state was confirmed for any R2 element, the coercivity had a value greater than HcJ (predicted value from composition). From this fact, it can be seen that a permanent magnet having a high magnetic anisotropy due to trivalent Ce is obtained regardless of the R2 element.

Examples 30 and 32

In $((Ce_{1-p}R2_p)_{0.9}Zr_{0.1})Fe_7X3q$ (R2=Nd, p=0.5, X3=N, q=0.6), C3/(C3+C4) was high and the coercivity HcJ also had a high value. From this fact, it can be seen that a high coercivity due to trivalent Ce is obtained regardless of the presence or absence of substitution with Zr. Furthermore, it can be seen that the saturation magnetic flux density is improved by substitution with Zr.

Next, Examples of an R-T compound of which the main phase grains have a $ThMn_{12}$ type crystal structure (space group I4/mmm) will be described. Hereinafter, the present invention will be more specifically described with reference to Examples and Comparative Examples, but the present invention is not limited to the following Examples in any way.

Examples 33 to 39 and Comparative Examples 19 to 24

Predetermined amounts of a Ce metal, a Fe metal, and a Ti metal were weighed so that the main phase grains had a composition of $CeFe_{11}Ti$, and a thin plate-shaped Ce—Fe—Ti alloy was fabricated by a strip casting method. This alloy was subjected to a heat treatment while being stirred in a hydrogen stream to be formed into a coarse powder, oleic acid amide as a lubricant was then added thereto, the coarse powder was formed into a fine powder (average particle diameter: 3 μm) in a non-oxidizing atmosphere by using a jet mill. The fine powder thus obtained was filled in a mold (opening size: 20 mm×18 mm) and subjected to uniaxial pressure molding at a pressure of 2.0 ton/cm$^2$ while applying a magnetic field of 1600 kA/m in the perpendicular direction to the pressurizing direction. The molded body thus obtained was heated up to the optimal sintering temperature, retained for from 15 hours to 30 hours at a sintering temperature of from 700° C. to 1000° C. while applying a pressure of from 1.0 GPa to 10.0 GPa in the direction perpendicular to the easy axis, then cooled to room temperature, subsequently subjected to the aging treatment for 1 hour at 600° C., thereby obtaining a sintered magnet. The manufacturing conditions in the respective Examples and Comparative Examples are presented in Table 4.

The magnetic properties of the sintered magnet thus obtained were measured by using a BH tracer and applying a magnetic field of ±5600 kA/m in the easy axis direction. Incidentally, the magnetic flux density was confirmed to be within a range of ±5% at the time of applying +4800 kA/m and +5600 kA/mT, and the value at the time of applying +5600 kA/m was adopted as the saturation magnetic flux density. The saturation magnetic flux density and coercivity HcJ measured in this manner are presented in Table 4.

It was confirmed that the main generated phase of the sintered magnet thus obtained was attributed to the $ThMn_{12}$ type crystal structure (space group I4/mmm) by XRD. Subsequently, the sintered magnet was processed into a flake shape having a thickness of 100 nm by using a FIB device, the vicinity of the center of the main phase grains was analyzed by using an EDS device equipped to a STEM, and the composition of the main phase grains was quantified. Subsequently, the observable position of the main phase grains was adjusted in the STEM, and the EELS spectra were obtained. The compositions of the respective main phase grains and C3/(C3+C4) calculated from the EELS spectra are presented in Table 4.

The sintered magnet was corroded by using a testing machine for a PCT under the conditions of 120° C., 2 atm, 100% RH, and 200 hours, the corrosion on the surface of the sintered magnet was then removed, the weight change rate of the sintered magnet was determined. The results are presented in Table 4.

TABLE 4

| | Composition of main phase grains | Sintering temperature ° C. | Sintering time h | Sintering pressure GPa | Saturation magnetic flux density mT | HcJ kA/m | C3/(C3 + C4) | Weight change rate % |
|---|---|---|---|---|---|---|---|---|
| Example 33 | $CeFe_{11}Ti$ | 900 | 20 | 3.0 | 1140 | 215 | 0.43 | −0.15 |
| Example 34 | $CeFe_{11}Ti$ | 800 | 20 | 3.0 | 1104 | 196 | 0.35 | −0.12 |
| Example 35 | $CeFe_{11}Ti$ | 1000 | 20 | 3.0 | 1117 | 206 | 0.39 | −0.13 |
| Example 36 | $CeFe_{11}Ti$ | 900 | 25 | 3.0 | 1138 | 217 | 0.44 | −0.17 |
| Example 37 | $CeFe_{11}Ti$ | 900 | 30 | 3.0 | 1145 | 220 | 0.45 | −0.17 |
| Example 38 | $CeFe_{11}Ti$ | 900 | 20 | 5.0 | 1157 | 229 | 0.49 | −0.18 |
| Example 39 | $CeFe_{11}Ti$ | 900 | 20 | 2.0 | 1053 | 162 | 0.17 | — |
| Comp. Example 19 | $CeFe_{11}Ti$ | 750 | 20 | 3.0 | 1030 | 102 | 0.08 | — |
| Comp. Example 20 | $CeFe_{11}Ti$ | 900 | 15 | 3.0 | 1041 | 104 | 0.09 | — |
| Comp. Example 21 | $CeFe_{11}Ti$ | 700 | 30 | 3.0 | 1025 | 102 | 0.08 | — |
| Comp. Example 22 | $CeFe_{11}Ti$ | 900 | 20 | 6.0 | 1148 | 229 | 0.53 | −1.34 |
| Comp. Example 23 | $CeFe_{11}Ti$ | 900 | 20 | 10.0 | 1150 | 227 | 0.57 | −1.58 |
| Comp. Example 24 | $CeFe_{11}Ti$ | 900 | 20 | 1.0 | 1003 | 95 | 0.05 | — |

Examples 33 to 35 and Comparative Example 19

For $CeFe_{11}Ti$, only the sintering temperature was changed between 750° C. and 1000° C. In a case in which the sintering temperature was from 800° C. to 1000° C. (Examples 33 to 35), C3/(C3+C4) was high and the coercivity HcJ also had a high value, but C3/(C3+C4) was low and the coercivity HcJ also decreased in a case in which the sintering temperature was 750° C. (Comparative Example 19). It can be seen that a high coercivity is expressed in the main phase grains as the shrinkage rate changes depending on the sintering temperature and a trivalent Ce state is stabilized.

Examples 33, 36, and 37 and Comparative Example 20

For $CeFe_{11}Ti$, only the sintering time was changed between 15 h and 30 h. In a case in which the sintering time was 20 h or longer (Examples 33, 36, and 37), both C3/(C3+C4) and the coercivity HcJ had a high value, but both C3/(C3+C4) and the coercivity HcJ exhibited a behavior of being saturated even when the sintering time was increased. On the other hand, both C3/(C3+C4) and the coercivity HcJ had a lower value in a case in which the sintering time was 15 h (Comparative Example 20) as compared to the case in which the sintering time was 20 h or longer. From this fact, it can be seen that the difference in shrinkage rate is remarkable by a sufficient sintering time, the stabilization of a trivalent Ce state is promoted, and the main phase grains has a higher coercivity.

Example 37 and Comparative Example 21

For $CeFe_{11}Ti$, the sintering time was 30 h and only the sintering temperature was changed to 700° C. and 900° C. In a case in which the sintering temperature was 700° C. (Comparative Example 21), both C3/(C3+C4) and the coercivity HcJ significantly decreased as compared to a case in which the sintering temperature was 900° C. (Example 37). From this fact, it can be seen that a change in shrinkage rate occurs by a sufficient sintering temperature and a sufficient sintering time, a trivalent Ce state is stabilized in the main phase grains, and an increase in the coercivity occurs.

Examples 33, 38 and 39 and Comparative Examples 22 to 24

For $CeFe_{11}Ti$, only the sintering pressure was changed between 1.0 GPa and 10.0 GPa. In a case in which the sintering pressure was from 2.0 GPa to 5.0 GPa (Examples 33, 38 and 39), both C3/(C3+C4) and the coercivity HcJ had a high value, both C3/(C3+C4) and the coercivity HcJ tended to increase along with an increase in sintering pressure. On the other hand, in a case in which the sintering pressure was 6.0 GPa or more (Comparative Examples 22 and 23), C3/(C3+C4) increased to be more than 0.5 but the coercivity HcJ was not greatly changed, and the weight change rate measured by the PCT test was significantly great. From this fact, it can be seen that the abundance of Ce in a trivalent state to be easily oxidized increases, and the corrosion resistance significantly decreases in a case in which C3/(C3+C4) increases to be more than 0.5. In addition, a case in which the sintering pressure was not applied or a case in which 3.0 GPa was isotropically applied was also investigated, but C3/(C3+C4) was less than 0.1 and a high coercivity was not obtained in both cases.

Examples 40 to 48 and Comparative Examples 25 and 26

Predetermined amounts of a Ce metal, a R3 metal, a Fe metal, and a Ti metal were weighed so that the main phase grains had a composition of $(Ce_{1-m}R3_m)Fe_{11}Ti$ (R3=Y, Gd, Nd, or Dy, $0 \leq m \leq 0.75$), and a thin plate-shaped Ce—R3-Fe—Ti alloy was fabricated by a strip casting method. A sintered body was obtained from this alloy by the same method as in [0104]. However, the conditions for manufacturing the sintered body which correspond to the respective Examples and Comparative Examples are as described in Table 5. Furthermore, this sintered body was subjected to a heat treatment while being stirred in a hydrogen stream to be formed into a coarse powder, oleic acid amide as a lubricant was then added thereto, the coarse powder was formed into a fine powder (average particle diameter: 3 μm) in a non-oxidizing atmosphere by using a jet mill. If necessary, this fine powder was subjected to a heat treatment for 10 hours at a temperature of 400° C. in a nitrogen gas or hydrogen gas at 1 atm. Thereafter, the fine powder and paraffin were packed in a case, and the fine powder was oriented by applying a magnetic field of 1600 kA/m in a state in which the paraffin was molten, thereby molding a bonded magnet.

The bonded magnet thus obtained was subjected to the evaluation by a BH tracer, XRD, EDS, EELS, and PCT under the same conditions as those for the sintered magnet of a $ThMn_{12}$ type R-T compound described above. Incidentally, the composition of the main phase grains was calculated in consideration of the results obtained by the infrared absorption method in a case in which the main phase grains contained an interstitial element "X". The results are presented in Table 5.

In addition, the predicted value of the coercivity HcJ in a case in which Ce was in a tetravalent state was calculated for the compositions of the respective main phase grains. For the calculation, a bonded magnet was fabricated under the following conditions. The sintering pressure was not applied but other fabricating conditions were the same as those in Example 41 so that the compositions of the main phase grains were $CeFe_{11}TiN_{1.5}$, $YFe_{11}TiN_{1.5}$, $GdFe_1TiN_{1.5}$, $NdFe_{11}TiN_{1.5}$, and $DyFe_{11}TiN_{1.5}$. The valence of Ce in the $CeFe_{11}TiN_{1.5}$ bonded magnet thus fabricated was evaluated by the same method as in [0106]. As a result, C3/(C3+C4) was less than 0.1, that is, a tetravalent state was dominant.

The predicted value of the coercivity HcJ corresponding to the composition of main phase grains in Examples 43 to 48 and Comparative Examples 25 and 26 was calculated by using the results of coercivity HcJ for these bonded magnets measured by using a BH tracer. For the calculation, it was presumed that the composition of main phase grains and the coercivity HcJ linearly corresponded to each other and [Mathematical formula 5] was used. Here, the composition of main phase grains is defined as $(Ce_{1-m}R3_n)Fe_{11}TiN_{1.5}$, the coercivity HcJ of $CeFe_1TiN_{1.5}$ is defined as HcJ (Ce), and the coercivity HcJ of $R3Fe_{11}TiN_{1.5}$ is defined as HcJ (R3). The results of this calculation are presented in Table 5 as HcJ (predicted value from composition) in a case in which Ce in a tetravalent state is dominant.

$$\text{HcJ(predicted value from composition)}=(1-m)\times\text{HcJ(Ce)}+m\times\text{HcJ(R3)} \quad \text{[Mathematical formula 5]}$$

subjected to a hydrogenation treatment (Example 42), C3/(C3+C4) was high and the coercivity HcJ also had a high value. From this fact, it can be seen that a high coercivity due to trivalent Ce is obtained even after an interstitial element "X" is introduced. Furthermore, it can be seen that the coercivity is improved by introducing an interstitial element "X" as compared to a case in which an interstitial element "X" is not introduced (Example 40).

Examples 41 and 43 to 46 and Comparative Examples 25 and 26

In $(Ce_{1-m}R3_m)Fe_{11}TiX4_n$ (R3=Y or Gd, $0 \le m < 0.75$, X4=N, n=1.5), C3/(C3+C4) is higher as the amount "m" substituted with R3 is smaller, that is, the Ce amount is greater, and the coercivity HcJ is a value greater than the value predicted from the composition ratio of the rare earth elements. However, C3/(C3+C4) and the value of coercivity HcJ both significantly decreased in a case in which m=0.75 (Comparative Examples 25 and 26). From this fact, it can be seen that a change in Ce valence state contributes to the magnetic anisotropy in the main phase and it is responsible for an increase in coercivity to HcJ (predicted value from composition) or more.

Examples 44 and 46 to 48

In $(Ce_{1-m}R3_m)Fe_{11}TiX4_n$ (R3=Y, Gd, Nd, or Dy, m=0.5, X4=N, n=1.5), a trivalent Ce state was confirmed for any R3 element, and the coercivity had a value greater than HcJ (predicted value from composition). From this fact, it can be seen that a permanent magnet having a high magnetic anisotropy due to trivalent Ce is obtained regardless of the R3 element.

TABLE 5

| | Composition of main phase grains | Sintering temperature ° C. | Sintering time h | Sintering pressure GPa | Saturation magnetic flux density mT | HcJ kA/m | HcJ (predicted value from composition) kA/m | C3/(C3 + C4) | Weight change rate % |
|---|---|---|---|---|---|---|---|---|---|
| Example 40 | $CeFe_{11}Ti$ | 900 | 20 | 3.0 | 1049 | 225 | — | 0.43 | −0.15 |
| Example 41 | $CeFe_{11}TiN_{1.5}$ | 900 | 20 | 3.0 | 1210 | 444 | — | 0.45 | −0.12 |
| Example 42 | $CeFe_{11}TiH$ | 900 | 20 | 3.0 | 1150 | 417 | — | 0.41 | −0.11 |
| Example 43 | $(Ce_{0.75}Y_{0.25})Fe_{11}TiN_{1.5}$ | 900 | 20 | 3.0 | 1186 | 325 | 91 | 0.35 | −0.12 |
| Example 44 | $(Ce_{0.50}Y_{0.50})Fe_{11}TiN_{1.5}$ | 950 | 20 | 3.0 | 1150 | 253 | 97 | 0.29 | −0.10 |
| Example 45 | $(Ce_{0.75}Gd_{0.25})Fe_{11}TiN_{1.5}$ | 900 | 20 | 3.0 | 1089 | 320 | 95 | 0.33 | −0.09 |
| Example 46 | $(Ce_{0.50}Gd_{0.50})Fe_{11}TiN_{1.5}$ | 950 | 20 | 3.0 | 968 | 258 | 105 | 0.28 | −0.08 |
| Example 47 | $(Ce_{0.50}Nd_{0.50})Fe_{11}TiN_{1.5}$ | 900 | 20 | 3.0 | 1234 | 599 | 442 | 0.29 | −0.10 |
| Example 48 | $(Ce_{0.50}Dy_{0.50})Fe_{11}TiN_{1.5}$ | 950 | 20 | 3.0 | 944 | 718 | 568 | 0.27 | −0.06 |
| Comp. Example 25 | $(Ce_{0.25}Y_{0.75})Fe_{11}TiN_{1.5}$ | 950 | 20 | 3.0 | 1182 | 101 | 103 | 0.06 | — |
| Comp. Example 26 | $(Ce_{0.25}Gd_{0.75})Fe_{11}TiN_{1.5}$ | 900 | 20 | 3.0 | 889 | 110 | 114 | 0.07 | — |

Examples 33 and 40

For $CeFe_{11}Ti$, a sintered magnet and a bonded magnet were fabricated. In both cases of a sintered magnet (Example 33) and a bonded magnet (Example 40), C3/(C3+C4) was high and the coercivity HcJ also had a high value. From this fact, it can be seen that a high coercivity due to trivalent Ce is obtained in both of a sintered magnet and a bonded magnet.

Examples 40 to 42

For $CeFe_{11}Ti$, a bonded magnet subjected to a nitriding treatment before being bonded and a bonded magnet subjected to a hydrogenation treatment before being bonded were fabricated. In both cases of a bonded magnet subjected to a nitriding treatment (Example 41) and a bonded magnet

The invention claimed is:

1. A rare earth permanent magnet comprising main phase grains, wherein an abundance ratio C3/(C3+C4) in the main phase grains is $0.1 \le C3/(C3+C4) \le 0.5$, where C3 denotes the number of trivalent Ce atoms and C4 denotes the number of tetravalent Ce atoms in the main phase grains, and the main phase grains comprise an R-T compound having a $TbCu_7$ crystal structure (space group P6/mmm), where "R" represents Ce or Ce and one or more kinds of rare earth elements selected from the group consisting of Y, La, Pr, Nd, Sm, Eu, Gd, Tb, Dy, Ho, Er, Tm, Yb, and Lu, and "T" represents one or more kinds of transition metal elements including Fe or Fe and Co.

2. The rare earth permanent magnet according to claim 1, wherein the main phase grains further contain an interstitial element "X" ("X" represents one or more elements of N, H, Be, and C).

3. The rare earth permanent magnet according to claim 2, wherein "R" is partially substituted with Zr in the main phase grains.

4. The rare earth permanent magnet according to claim 3, wherein the abundance ratio of the number of trivalent Ce atoms and the number of tetravalent Ce atoms in the main phase grains is calculated from an electron energy loss spectrum.

5. The rare earth permanent magnet according to claim 2, wherein the abundance ratio of the number of trivalent Ce atoms and the number of tetravalent Ce atoms in the main phase grains is calculated from an electron energy loss spectrum.

6. The rare earth permanent magnet according to claim 1, wherein "R" is partially substituted with Zr in the main phase grains.

7. The rare earth permanent magnet according to claim 6, wherein the abundance ratio of the number of trivalent Ce atoms and the number of tetravalent Ce atoms in the main phase grains is calculated from an electron energy loss spectrum.

8. The rare earth permanent magnet according to claim 1, wherein the abundance ratio of the number of trivalent Ce atoms and the number of tetravalent Ce atoms in the main phase grains is calculated from an electron energy loss spectrum.

9. A rare earth permanent magnet comprising main phase grains, wherein an abundance ratio C3/(C3+C4) in the main phase grains is $0.1 \leq C3/(C3+C4) \leq 0.5$, where C3 denotes the number of trivalent Ce atoms and C4 denotes the number of tetravalent Ce atoms in the main phase grains, and the main phase grains comprise an R-T compound having a $ThMn_{12}$ crystal structure (space group 14/mmm), where "R" represents Ce or Ce and one or more kinds of rare earth elements selected from the group consisting of Y, La, Pr, Nd, Sm, Eu, Gd, Tb, Dy, Ho, Er, Tm, Yb, and Lu, and "T" represents one or more kinds of transition metal elements including Fe or Fe and Co or represents the transition metal elements partially substituted with "M" ("M" represents one or more elements selected from the group consisting of Ti, V, Cr, Mo, W, Zr, Hf, Nb, Ta, Al, Si, Cu, Zn, Ga, and Ge).

10. The rare earth permanent magnet according to claim 9, wherein the main phase grains further contain an interstitial element "X" ("X" represents one or more kinds of elements of N, H, Be, and C).

11. The rare earth permanent magnet according to claim 10, wherein the abundance ratio of the number of trivalent Ce atoms and the number of tetravalent Ce atoms in the main phase grains is calculated from an electron energy loss spectrum.

12. The rare earth permanent magnet according to claim 9, wherein the abundance ratio of the number of trivalent Ce atoms and the number of tetravalent Ce atoms in the main phase grains is calculated from an electron energy loss spectrum.

* * * * *